US005855318A

United States Patent [19]

Baxter

[11] Patent Number: 5,855,318

[45] **Date of Patent: *Jan. 5, 1999**

[54] INTERLOCKING ARRANGEMENT FOR PANELS

[75] Inventor: Ronald A. Baxter, Douglasville, Ga.

[73] Assignee: The Mead Corporation, Dayton, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 956,798

[22] Filed: Oct. 23, 1997

[51] Int. Cl.[6] ..... B26D 5/42

[52] U.S. Cl. ..... 229/198.2; 206/427

[58] Field of Search ..... 229/198.2; 206/140, 206/148, 434, 15, 103.2, 427

[56] References Cited

U.S. PATENT DOCUMENTS

| | | | |
|---|---|---|---|
| 2,950,854 | 8/1960 | Ganz . | |
| 3,361,254 | 1/1968 | Weiss . | |
| 3,361,331 | 1/1968 | Weiss . | |
| 3,381,881 | 5/1968 | Ganz et al. | 206/140 X |
| 3,497,924 | 3/1970 | Lock . | |
| 4,386,699 | 6/1983 | Sutherland | 206/434 |
| 4,516,718 | 5/1985 | Forbes, Jr. | 229/146 |
| 4,708,284 | 11/1987 | Sutherland et al. . | |
| 4,869,423 | 9/1989 | Marie . | |
| 5,360,104 | 11/1994 | Sutherland . | |
| 5,398,870 | 3/1995 | Bienaime | 229/198.2 |

FOREIGN PATENT DOCUMENTS

| | | |
|---|---|---|
| DE 3407348 A1 | 11/1984 | Germany . |

*Primary Examiner*—Allan N. Shoap
*Assistant Examiner*—Tri M. Mai
*Attorney, Agent, or Firm*—Michael V. Drew

[57] ABSTRACT

An interlocking arrangement (10) for panels has a locking tab (20) having a nose (22) and a base of a first width $W_T$ including at least one transverse segmented base edge (24) having have an outermost vane (26) and at least one inner vane (28). The locking tab is received by a locking slit (30) of a second width $W_S$ less than the first width of the locking tab.

10 Claims, 2 Drawing Sheets

INTERLOCKING ARRANGEMENT FOR PANELS

The invention relates generally to interlocking arrangements for panels, and more particularly to an interlocking arrangement for panels wherein a male locking member has a segmented base for cooperative locking engagement with a narrower locking slit.

In the packaging of articles, particularly the packaging of multi-paks of articles in wrap-around type cartons, interlocking arrangements are useful for maintaining closure of the carton about the articles. It can be appreciated that it is important and would be useful to have secure interlocking arrangements for panels of cartons and other items.

SUMMARY OF THE INVENTION

The present invention provides a locking tab having a segmented base and a narrower locking slit for receiving the locking tab.

Other advantages and objects of the present invention will be apparent from the following description, the accompanying drawings, and the appended claims.

DETAILED DESCRIPTION OF THE PREFERRED EMBODIMENT

Figure 1:
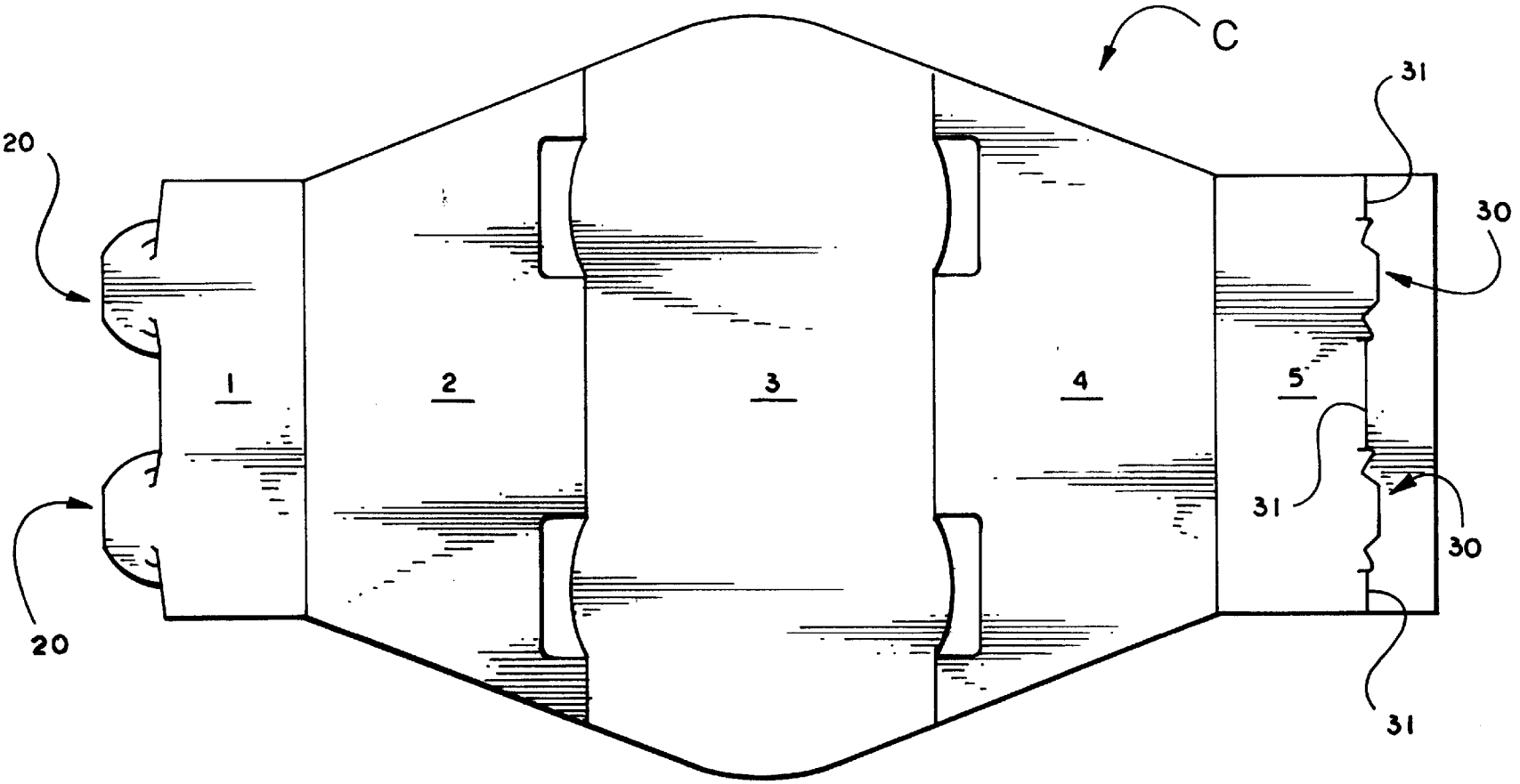
FIG. 1 is a plan view illustration of a carton blank including an interlocking arrangement for panels in accordance with a preferred embodiment of the invention.

Throughout the drawings the same reference numerals are used to denote the same features.

Figure 2:
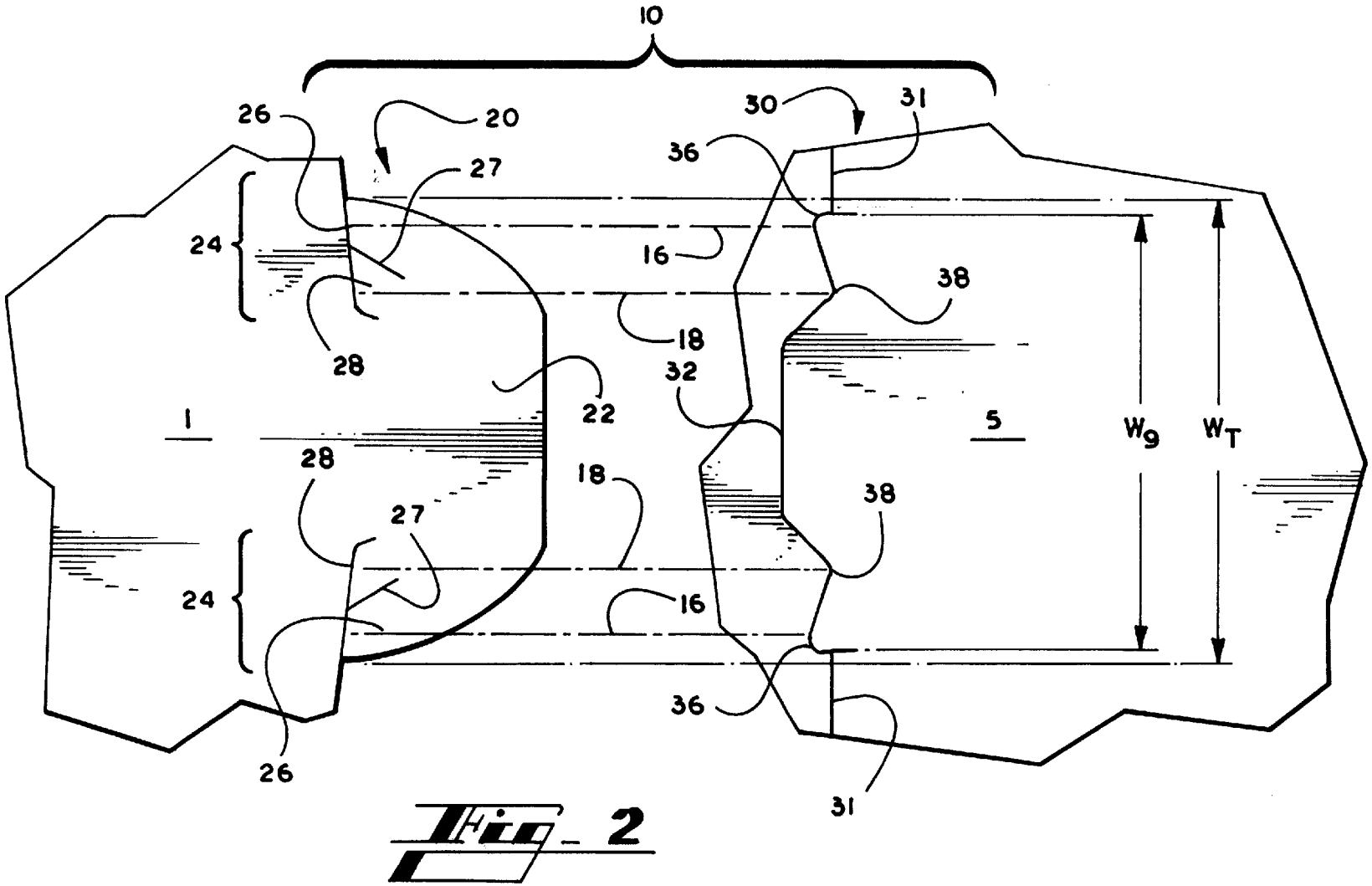
FIG. 2 is a plan view illustration showing the locking tab and locking slit of the interlocking arrangement of FIG. 1 positioned for engagement.

Referring first to FIGS. 1 and 2 simultaneously, therein are illustrated a carton blank C which includes an interlocking arrangement 10 for panels in accordance with a preferred embodiment of the invention. Referring now more particularly to FIG. 1, it is noted that the carton B with which the interlock arrangement is illustrated is a wrap-around type carton having closure panels 1 and 5, side wall panels 2 and 4, and top panel 3. Male locking members 20 extend from one of the closure panels 1 while corresponding locking slits 30 are formed in the other closure panel 5. The locking slits are formed along a fold line 31 or other weakened line in the closure panel 5.

Referring now to both FIGS. 1 and 2, the elements of the locking arrangements will be discussed in greater detail. In FIG. 2, a pair of a locking tab 20 and a locking slit 30 are shown in alignment for engagement. The locking tab 20 consists of a nose 22 and a base portion. In the preferred embodiment illustrated the base portion is bifurcated about the point of attachment of the locking tab 20 to the closure panel 1. Thus, what may be referred to as opposed transverse base portions 24 form the unattached portion of the tab 20 which is opposite the foremost portion of the nose 22. Each base portion 24 is segmented by segmenting lines 27 into an outermost vane 26 and at least one inner vane 28. The segmenting lines 27 may be score lines (such as fold lines) or cut lines which create weakened or severed boundaries between adjacent vanes 26, 28. Also, an imaginary extension of each of the segmenting lines 27 intersects the outer edge of the closure panel 1.

The locking slit 30 has a configuration which promotes engagement of the tab 20 and slit 30. Although the slit could be a simple linear or curvilinear aperture, in the preferred embodiment the locking slit 30 consists of several elements. The locking slit 30 has a leading edge 32 for receiving the nose portion 22 of the locking tab 20. As further illustrated by the preferred embodiment the leading edged 32 may be disposed between curvilinear segments which are substantially S-shaped or zig-zagged-shaped. Referring particularly to FIG. 2 it can be seen that reversely-oriented segments 36, 38 of the curvilinear segments are disposed such that they may overlie adjacent vanes 26, 28 of the locking tab 20. For example, adjacent convex 36 and concave 38 portions are illustrated by reference lines 16, 18 to be in position to overlie adjacent vanes 26, 28 when the base of the locking tab 20 is inserted through the locking slit 30.

In operation, initially the outermost portion of the closure panel 5 is folded to expose the locking slit. The leading edge 32 protrudes outwardly of the slit 30 because of the exposure of the slit 30. The nose 22 of the locking tab 20 is engaged under the leading edge 32 of the locking slit 30. Because of this initial engagement the tab 20 is positioned for insertion into the slit. The width of the base of the locking tab 20, which is denoted by the reference characters $W_T$, is greater than the width $W_S$ of the locking slit 30. As the locking tab 20 is pushed through the locking slit 30 the difference in widths $W_T$, $W_S$ causes the vanes 26, 28 to be pushed inwardly toward one another. Consequently, because of this constriction adjacent vanes 26, 28 are displaced to a position where they do not lie in a common plane. The S- (or zig-zagged-) shaped portions 36, 38 of the locking slits 30 promote the displacement action. The base of the tab 20 is thus forcibly decreased to a width sufficient to allow the base to pass through the slit 30. After passing through the narrower slit 30, the base attempts to revert to a width $W_T$ closer to its original width, and in general assumes a width at least greater than that of the width $W_S$ of the slit 30. The difference in widths between the width $W_T$ of base of the inserted locking tab 20 and the width $W_S$ of the slit 30 cause the locking tab 20 to be firmly engaged by the locking slit 30 and not easily separated therefrom.

Modifications may be made in the foregoing without departing from the scope and spirit of the claimed invention. For example, the vanes 26, 28 may be separated not only by cut lines or fold lines, but also weakened severance lines such as perforated lines. As a further example, it is to be noted that the preferred embodiment of the invention is illustrated with an outermost vane 26 and a single inner vane 28 on each transverse edge 24 because the invention only requires that at least one transverse edge 24 be used. However, the invention encompasses a structure of multiple inner vanes 28. It is also noted that although the invention has been illustrated and described with transverse edges 24 lying on either side of the point of connection of the locking tab 20 to the closure panel 1, the invention also encompasses a structure of only one transverse edge 24. Thus, a locking tab 20 having at least one transverse edge 24 is contemplated by and within the scope of the invention. It is further noted that although the panels 1, 5 upon which the elements of the interlocking arrangement 10 are illustrated may be considered bottom panels of the carton shown, use of the interlocking arrangement 10 with panels that ultimately serve as top, side, end or other panels that form a closure is encompassed by and within the scope and spirit of the invention.

What is claimed is:

1. An interlocking arrangement for panels comprising:

a locking tab extending from an outer edge of a first panel, said locking tab having a nose and a base, said base having a first width and including at least one transverse edge segmented into an outermost vane and at least one inner vane by at least one segmenting line intersecting said transverse edge and whose imaginary extension thereof intersecting said outer edge; and a locking slit disposed within a second panel for receiving said locking tab having a second width less than said first width such that as said locking tab is urged through said locking slit at least one of said outermost vane and said inner vane is urged into non-coplanar alignment with respect to one another thereby decreasing said first width and after said base passes through said locking slit said base reverts to a third width greater than said second width.

2. The interlocking arrangement of claim 1, said locking slit having a configuration which promotes non-coplanar alignment of said outermost vanes and said inner vanes.

3. The interlocking arrangement of claim 2, said configuration which promotes non-coplanar alignment including a leading edge which protrudes from adjacent portions of said locking slit disposed for alignment with said nose such that when said locking tab is initially urged through said locking slit said leading edge may overlap said nose.

4. The interlocking arrangement of claim 2, said configuration which promotes non-coplanar alignment including a leading edge which protrudes from and lies between adjacent substantially S-shaped portions of said locking slit disposed such that when said locking tab is initially urged through said locking slit said leading edge overlaps said nose and when said base is urged through said slit adjacent concave and convex portions of said substantially S-shaped portions overlie adjacent ones of said at least one inner vane and said outermost vane.

5. The interlocking arrangement of claim 1, wherein said at least one segmenting line is a base cut line.

6. The interlocking arrangement of claim 1, said at least one transverse edge comprising opposed transverse edges.

7. The interlocking arrangement of claim 6, said locking slit having a configuration which promotes non-coplanar alignment of said outermost vanes and said inner vanes.

8. The interlocking arrangement of claim 7, said configuration which promotes non-coplanar alignment including a leading edge which protrudes from adjacent portions of said locking slit disposed for alignment with said nose such that when said locking tab is initially urged through said locking slit said leading edge may overlap said nose.

9. The interlocking arrangement of claim 7, said configuration which promotes non-coplanar alignment including a leading edge which protrudes from and lies between adjacent substantially S-shaped portions of said locking slit disposed such that when said locking tab is initially urged through said locking slit said leading edge overlaps said nose and when said base is urged through said slit adjacent concave and convex portions of said substantially S-shaped portions overlie adjacent ones of said at least one inner vane and said outermost vane.

10. The interlocking arrangement of claim 6, wherein said opposed transverse edges are each segmented by at least one segmenting line into an outermost vane and at least one inner vane and each line comprises a base cut line.

* * * * *